US012064808B2

(12) United States Patent
Kusic

(10) Patent No.: US 12,064,808 B2
(45) Date of Patent: Aug. 20, 2024

(54) DIE CASTING MOLD, HOT CHAMBER SYSTEM, METHOD FOR DIE CASTING OF METAL AND USE OF A DIE CASTING MOLD

(71) Applicant: Ferrofacta GmbH, Allendorf (DE)

(72) Inventor: Igor Kusic, Allendorf (DE)

(73) Assignee: Ferrofacta GmbH, Allendorf (DE)

( * ) Notice: Subject to any disclaimer, the term of this patent is extended or adjusted under 35 U.S.C. 154(b) by 0 days.

(21) Appl. No.: 18/080,801

(22) Filed: Dec. 14, 2022

(65) Prior Publication Data

US 2023/0182198 A1 Jun. 15, 2023

(30) Foreign Application Priority Data

Dec. 14, 2021 (DE) ..... 102021132870.5

(51) Int. Cl.

| | |
|---|---|
| ***B22D 17/20*** | (2006.01) |
| ***B22D 17/02*** | (2006.01) |
| ***B22D 17/22*** | (2006.01) |
| ***B22D 27/00*** | (2006.01) |

(52) U.S. Cl.

CPC ..... *B22D 17/2084* (2013.01); *B22D 17/02* (2013.01); *B22D 17/2023* (2013.01); *B22D 17/22* (2013.01); *B22D 27/003* (2013.01)

(58) Field of Classification Search

CPC ..... B22D 17/2084; B22D 17/02; B22D 17/2023; B22D 17/22; B22D 17/2236; B22D 27/003

See application file for complete search history.

(56) References Cited

U.S. PATENT DOCUMENTS 3,903,956 A * 9/1975 Pekrol ..... B22D 17/2272 249/67
7,896,059 B2 * 3/2011 Hetke ..... B22D 18/06 164/335

FOREIGN PATENT DOCUMENTS

| | | | |
|---|---|---|---|
| DE | 2441956 | A1 | 3/1975 |
| WO | 2012076008 | A2 | 6/2012 |
| WO | 2013071926 | A2 | 5/2013 |
| WO | 2017148457 | A1 | 9/2017 |

* cited by examiner

*Primary Examiner* — Kevin P Kerns
*Assistant Examiner* — Steven S Ha
(74) *Attorney, Agent, or Firm* — Michael Soderman

(57) ABSTRACT

A diecasting mold, comprising a first mold plate which is hot in operation and comprising at least one diecasting nozzle with an outlet point for a melt, and a second mold plate which forms a cold side. A mold cavity is formed between the first and second mold plates in a closed state of the diecasting mold, in which mold cavity a molded part can be produced from solidified melt introduced into the mold cavity via at least one melt channel, at least one diecasting nozzle and the at least one gate. The diecasting mold further comprises a demolding system, the demolding system comprising an ejector assembly, a drive device, and a force transmission device. A hot chamber system for diecasting metal melt according to the hot chamber method is also taught, a method for diecasting metal, and a use of a diecasting mold.

6 Claims, 2 Drawing Sheets

DIE CASTING MOLD, HOT CHAMBER SYSTEM, METHOD FOR DIE CASTING OF METAL AND USE OF A DIE CASTING MOLD

CROSS REFERENCE TO RELATED APPLICATIONS

This application claims the priority of DE 102021132870.5 filed on 2021 Dec. 14; this application is incorporated by reference herein in its entirety.

BACKGROUND

The invention relates to a diecasting mold comprising a first mold plate which is hot in operation and has at least one diecasting nozzle with an outlet point for a melt, and a second mold plate which forms a cold side, a mold cavity being formed between the first and the second mold plate in a closed state of the diecasting mold, in which mold cavity a molded part can be produced from solidified melt introduced into the mold cavity via at least one melt channel and the at least one diecasting nozzle, the diecasting mold further comprising a demolding system for demolding the molded part from the diecasting mold, the demolding system comprising an ejector assembly, a drive device, and a force transmission device connected to the drive device and the ejector assembly. The force transmission device serves to transmit drive forces to the ejector assembly.

The invention further relates to a hot chamber system for diecasting metal melt according to a hot chamber method in which melt is held in a liquid state at an outlet point of a diecasting nozzle which opens into a diecasting mold, the hot chamber system comprising a hot chamber diecasting machine with a casting vessel and a machine nozzle, via which the melt reaches the diecasting nozzle via a melt channel, wherein a plug of solidified melt interrupting a melt flow can be formed at an outlet point of the diecasting nozzle. The invention also relates to a method for diecasting metal provided in the form of a melt, and to a use of a diecasting mold.

The outlet point is the region of the diecasting nozzle from which the melt emerges during the casting process and where the sprue, to which one or more molded parts are attached, is formed. In the case of sprueless diecasting, in which only one molded part is formed in front of the diecasting nozzle at a time, the sprue is located directly on the molded part and is not separated. This side of the diecasting mold, which is the hot mold plate, is therefore also referred to as the gate side.

Parts of a typical permanent mold according to the prior art as used for diecasting include the following:

- platen,
- first mold plate, gate side,
- second mold plate, ejection side (opposite the gate side), the mold cavity being formed between the first mold plate and the second mold plate in the closed state of the diecasting mold,
- spacer bars for the ejector plates,
- ejector plates with ejector plungers,
- platen,
- connections for cooling bores, as well as
- hot channel or cold channel nozzle.

The demolding system, also known as a discharge or ejector unit, is used to remove a cast part from a mold cavity. The demolding system essentially consists of the ejector pressure plate and the ejector holding plate and a number of usually round ejectors, mostly ejector pins or sleeves, which depends on the contour of the molded part. The ejectors, which are held in place on the ejector holding plate by a collar, are now pushed forward by means of a drive device, usually an ejector bolt, and the ejector plate in order to eject the molded part from the diecasting mold, i.e., its mold cavity. For more complex molded part contours, the demolding system may also include more sophisticated functionality such as inclined ejectors, contour ejectors or flat ejectors. The demolding system is usually protected by limit switches or by restoring bolts which force the ejector package back when the tool is closed, if it has not been retracted beforehand in the event of a fault, in order to prevent errors in the program sequence and associated damage to the valuable molding components.

The ejector pressure plate is always designed to be stronger than the ejector holding plate, because it serves to transmit force and transmits the ejection force from the drive device, conventionally usually an ejector rod driven from outside the diecasting mold, to the ejectors.

Diecast metal components are often used when the end products into which they are incorporated need to embody a high-end appearance. Particular emphasis is placed on the visual finish and haptics of the visible surfaces. Such articles are usually subsequently finished with various chemical surface processes. Numerous electroplating and polymer-based coatings are available for this purpose. However, all these processes place special demands on the casting quality of the cast articles, i.e., the surfaces produced. Numerous applications such as in the fields of furniture, sanitary or vehicle interiors may be cited as examples.

Both the porosity of the molded parts, also called castings, and inclusions on the surface have a very negative effect on the subsequent surface. In addition, marks on the surface, such as those caused by ejectors, are not desirable. So far, the surface formed by the first mold plate has the marks of the gate, and the surface formed by the second mold plate has the marks of the ejectors. As a result, no side can be formed with a perfect, undisturbed surface.

In diecasting practice, there has been no need for placing the demolding system, also known as the ejector unit, in the fixed, hot side of the diecasting mold, also known as the gate side or nozzle side. A direct connection of the molded parts to the gate side, without subsequent removal of the sprue as a by-product of casting and corresponding finishing of the surface, was originally not possible anyway due to the lack of a suitable hot channel method.

However, prior art diecasting methods are now known which make this possible and describe sprueless diecasting. Diecasting methods and diecasting nozzle systems for use in a hot chamber system for diecasting metal melt are known from WO 2012/076008 A2, WO 2013/071926 A2 and WO 2017/148457 A1, in each of which a plug of solidified melt interrupting a melt flow can be formed directly at the gate at the surface of the subsequent molded part. Only the use of the aforementioned methods enables direct connection on the molded part and, in addition to material and energy savings, a significant increase in casting quality. The direct connection eliminates the sprue as a by-product of casting, which in conventional diecasting methods solidifies in the channels between the diecasting nozzle and the diecasting mold, binds the cast parts together after demolding in an undesirable manner and has to be removed at great expense.

In the prior art methods, however, even without sprue to be removed, impressions of the nozzles, the now minimized sprue region, are produced on the surface of the molded part on the hot side of the diecasting mold. At the same time, marks are created on the opposite side of the molded part, which are formed by the cold side of the mold with the ejectors located there. As a result, no high-quality side can be produced by the casting method alone. It is therefore an object of the present invention to provide a diecasting mold, a hot chamber system, a method for diecasting metal, and a use of a diecasting mold for producing a molded part having a high quality surface which has a surface quality which can be immediately processed further on one side without production-related disturbances in the surface due to gate or ejector.

SUMMARY

The invention relates to a diecasting mold (10), comprising a first mold plate (11) which is hot in operation and comprises at least one diecasting nozzle (6) with an outlet point (17) for a melt, and a second mold plate which forms a cold side. A mold cavity (14) is formed between the first and second mold plates in a closed state of the diecasting mold (10), in which mold cavity a molded part (16) can be produced from solidified melt (8) introduced into the mold cavity (14) via at least one melt channel (4), at least one diecasting nozzle (6) and the at least one gate (12). The diecasting mold (10) further comprises a demolding system (20) for demolding the molded part (16) from the diecasting mold (10), the demolding system (20) comprising an ejector assembly (28, 30), a drive device (21), and a force transmission device (24) connected to the drive device (21) and the ejector assembly (28, 30). According to the invention, the demolding system (20) is arranged outside the region of the at least one melt channel (4), the at least one diecasting nozzle (6) and the at least one gate (12) and has sufficient temperature resistance to be arranged in the first mold plate (11). The invention further relates to a hot chamber system (1) for diecasting metal melt (8) according to the hot chamber method, a method for diecasting metal, and a use of a diecasting mold.

DETAILED DESCRIPTION

The object is achieved by a diecasting mold, comprising a first mold plate which is hot in operation and has at least one diecasting nozzle with an outlet point for a melt, and a second mold plate which forms a cold side. A mold cavity is formed between the first mold plate and the second mold plate in a closed state of the diecasting mold when the first mold plate and the second mold plate are in close contact with each other, in which mold cavity a molded part can be produced from solidified melt introduced into the mold cavity via at least one melt channel and the at least one diecasting nozzle. The diecasting mold further comprises a demolding system for demolding the molded part from the diecasting mold. The demolding system has an ejector assembly, preferably comprising ejector pins or an ejector sleeve, each held in an ejector holding plate. An ejector pressure plate transmits force to the ejector assembly when the cooled molded part is ejected. Therefore, the demolding system has an ejector assembly, a drive device, and a power transmission device connected to the drive device and the ejector assembly.

According to the invention, the demolding system is arranged in such a way, in particular with peripheral drive, outside the region of the at least one melt channel and the at least one diecasting nozzle, and in particular the drive device has such a temperature resistance, that an arrangement in the first mold plate becomes possible. The first mold plate heats up due to the entering melt or must have a sufficiently high temperature so that the melt can enter the mold cavity at the required temperature. The temperature of the first mold plate depends on the melt temperature. The temperature resistance of the drive device must therefore be guaranteed up to 300° C., for example.

In an advantageous embodiment of the invention, the drive device of the demolding system is peripherally arranged in the first mold plate, and at least two linear drives are arranged outside the region of the at least one melt channel, the at least one diecasting nozzle and its outlet point.

According to a further advantageous embodiment, the linear drives are configured as hydraulic drives, each comprising a hydraulic cylinder on both sides of the region of the melt channel and the diecasting nozzles. Alternatively, pneumatic or electric linear drives, spindle drives or other suitable embodiments may be used. A particularly preferred hydraulic cylinder is resistant to high temperatures and can withstand a temperature of up to 300° C. For example, it applies a force of 5 kN at 160 bar, with a pressure of $p_{max}$=220 bar being possible. The required temperature resistance of up to 300° C. also applies equally to the other drive systems intended for use. The temperature specification is exemplary as ultimately the respective melt temperature determines the requirements.

It has proven advantageous if the ejector assembly comprises discrete-acting ejector pins and/or is configured as a sleeve ejector in an annular shape around the outlet point of the diecasting nozzle. Both the ejector pins and the sleeve ejector may be equipped with a protective gas connection, a protective gas line inside and a protective gas outlet.

At least one protective gas outlet, e.g. a protective gas nozzle, has proved advantageous for delivering a protective gas into the mold cavity during demolding. The main advantage is realized especially when using flammable melts, such as magnesium. The latter can oxidize at high speed and burn, which can occur especially during demolding when residual liquid magnesium escapes from the diecasting nozzle.

As long as the newly formed molded part is in the mold cavity, the outlet point of the diecasting nozzle is closed by the solidified melt and the heat dissipation via the molded part prevents the sprue from melting. However, during demolding, when the molded part is ejected from the hot side by means of the ejectors, the condition at the outlet point, behind which the liquid melt is held in the nozzle for the next casting operation, becomes unstable. The sprue closed by a melt plug (the residue from the sprue that does not adhere to the molded part), i.e., the outlet point of the diecasting nozzle, may tear open and liquid melt may escape. Oxidation then occurs between the melt and the oxygen from the ambient air. This occurs highly exothermically in critical melts, especially magnesium, and triggers a fire.

Even if a major fire does not occur, oxide may still form especially in the region of the diecasting nozzle outlet point and damage the mold or diecasting nozzle. The use of protective gas during ejection can prevent fire and damage to the diecasting mold and the diecasting nozzle already at the potential point of origin.

Advantageously, the protective gas flows directly out of the ejector assembly, since the latter is located directly in the mold cavity and is substantially involved in ejecting the molded part. A protective gas outlet located further away, e.g. next to the mold cavity, would be less effective, since in this case the protective gas would first have to reach the mold cavity and would also have to be provided in larger quantities. Compared to an alternative protective gas outlet in the region of the mold cavity, which would involve additional disturbance of the surface of the diecasting mold and the molded part, the use of the ejector assembly to transport the protective gas inside it to the protective gas outlet and the targeted application offers an elegant solution.

The at least one protective gas outlet is therefore particularly preferably arranged in the ejector assembly which during ejection of the molded part enters the mold cavity directly, in this case in particular at a nozzle outlet point, i.e., the origin of such oxidation. In this context, particular advantages result from a modified arrangement in which the at least one protective gas outlet is arranged in the ejector wall, the wall of the ejector, for example on the inside of the wall of a sleeve ejector facing the outlet point of the diecasting nozzle. As a result, the protective gas is directed directly to the nozzle outlet point, where there is a particular risk of oxidation or the outbreak of a fire when critical melts are used, and is kept in this region by the sleeve ejector as if by a skirt. This results in high efficiency and low gas consumption.

According to a particularly advantageous embodiment, the protective gas outlet is arranged in a region that only emerges from the first mold plate during ejection, so that the protective gas outlet is unblocked during ejection only. This keeps the protective gas outlet covered, sealed and protected during the casting process. As a result, it is also prevented from causing additional disturbance to the surface. Multiple protective gas outlets are preferably arranged around the circumference of the wall of the ejector pins or the sleeve ejector in order to be able to deliver protective gas in sufficient quantities.

Any gas that can prevent oxidation and keeps the oxygen out of the ambient air can be used as a protective gas. However, it has proven advantageous if nitrogen is used as the protective gas, since this gas is readily available, is a harmless main constituent of ambient air, and requires no further safety precautions.

Advantageously, in particular for installation and maintenance, the demolding system is accessible via the mold cavity side of the first mold plate when the diecasting mold is open.

The object of the invention is also achieved by a hot chamber system for diecasting metal melt according to the hot chamber method, in which the melt is held in the liquid state at an outlet point of a diecasting nozzle which opens into a diecasting mold. The hot chamber system comprises a hot chamber diecasting machine with a casting vessel and a machine nozzle through which the melt enters a diecasting mold. A plug of solidified melt interrupting a melt flow can be formed at the outlet point of the diecasting nozzle. The hot chamber system further comprises at least one melt channel merging into a heating zone and a nozzle tip, which preferably form or are part of the diecasting nozzle, adjoined by a gate region of the diecasting mold. According to the invention, the diecasting mold is configured as a diecasting mold with a demolding system as previously described.

The object of the invention is further solved by a method for diecasting metal provided as a melt. According to the solution of the invention, in a diecasting mold with a demolding system as previously described, the steps of a. closing the mold by moving the first and second mold plates together and (en)closing the mold cavity,
b. introducing the melt from the outlet point of the diecasting nozzle into the mold cavity from the first mold plate, which forms the gate side and has the gate,
c. cooling and solidifying the melt to form the molded part,
d. opening the mold by lifting the second mold plate from the first and releasing the molded part,
e. activating the demolding system, which is also located in the first mold plate,
f. ejecting the molded part by releasing its adhesive connection with the first mold plate by the demolding system are performed. Steps d) and e) may be carried out simultaneously, especially if the process of opening the diecasting mold is mechanically coupled to the demolding system and the ejectors simultaneously eject the molded part. Alternatively, a stand-alone drive may activate the demolding system when required, for example, after the molded part has been gripped by a manipulator.

According to an advantageous configuration of the method, a protective gas keeping away the atmospheric oxygen flows into the mold cavity and to the outlet point of the diecasting nozzle during the release of the molded part. This is particularly advantageous for melts that have an inherent risk of strong oxidation and ignition. This applies in particular to magnesium, the processing of which is associated with a high fire risk. The use of protective gas during ejection can prevent fire at the potential point of origin.

Advantageously, the protective gas flows out of the ejector assembly, since the latter is located directly in the mold cavity and is substantially involved in ejecting the molded part. Further, it has proven advantageous if nitrogen is used as the protective gas, since this gas is a harmless main constituent of ambient air and therefore requires no further safety precautions.

The object is further achieved by the use of a diecasting mold as described above with the demolding system, configured as a diecasting mold for diecasting metal melt according to the hot chamber method, in which the melt is held in liquid state at an outlet point of the diecasting nozzle.

With the development and integration of the demolding system or ejector assembly into the first mold plate, the hot side of the diecasting mold as part of the hot channel system, both the surface quality and the integrity of the visible surface can be assured unaffected by nozzles or ejectors. Complicated processing steps such as grinding the visible surfaces or the sprue edges are no longer required. Surface defects, which are a major problem in any foundry, are greatly reduced. As a result, profitability increases. There is no need for time-consuming sorting of the produced molded parts according to the defects, which usually only become apparent only after coating and which ultimately lead to the disposal of the parts concerned lacking sufficient surface quality.

By using the diecasting nozzles known from the prior art, which open with their gate directly to the mold cavity or the molded part, the present invention can be used to produce a molded part that does not require any post-processing. The present invention also achieves that the side of the molded part opposite the gate can also be produced without impairing the surface by marks caused by the ejectors. Instead, these marks are relocated to the opposite side, where the molded part is affected by the gate anyway. This results in a completely unaffected surface that meets the highest requirements and can be used or finished without post-processing.

BRIEF DESCRIPTION OF THE DRAWINGS

The invention is explained in more detail below by way of a description of exemplary embodiments and their illustration in the corresponding drawings. In the drawings.

DETAILED DESCRIPTION OF THE PREFERRED EMBODIMENTS

Figure 1:
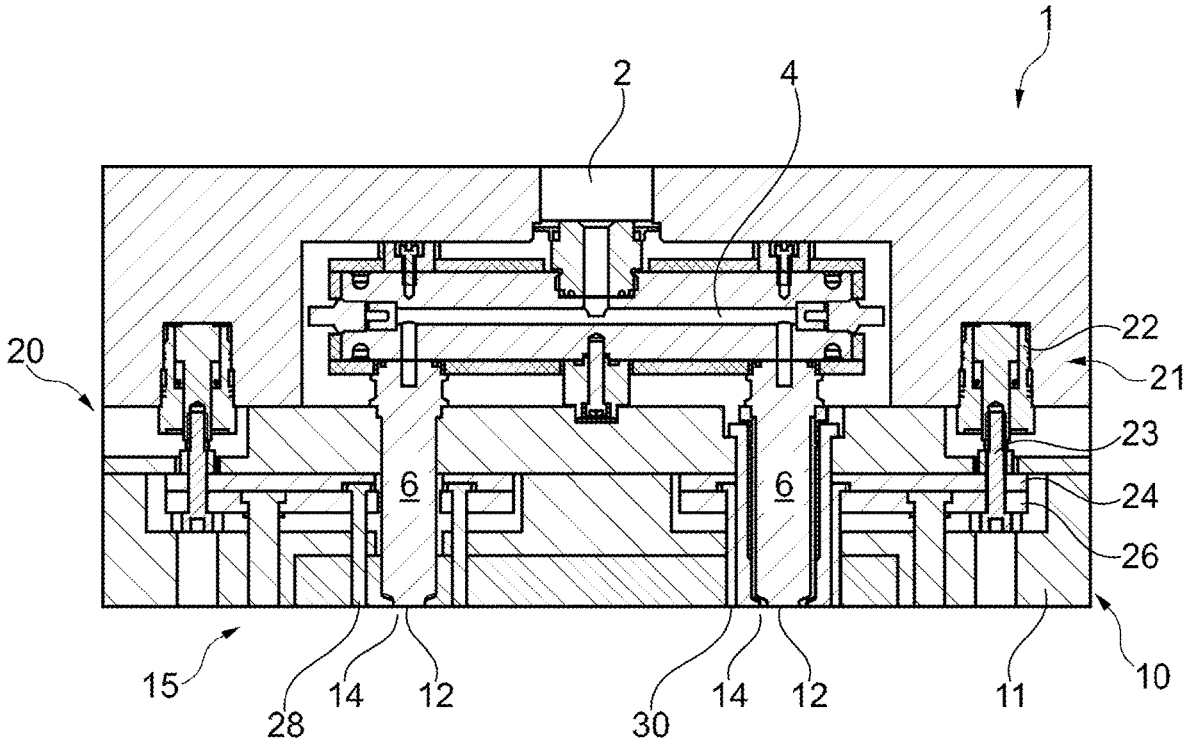
FIG. 1 schematically shows a cross-sectional view of an embodiment of a diecasting mold according to the invention.

FIG. 1 schematically shows a cross-sectional view of an embodiment of a diecasting mold 10 according to the invention with two diecasting nozzles 6, whose outlet point 17 opens into a mold cavity 14. A molded part 16 (see FIGS. 2 and 3) can be produced in the mold cavity 14 (at the bottom side of the diecasting mold 10 or the first mold plate 11, not shown). The diecasting mold 10 is part of a hot chamber system 1, of which only a section is shown and which, in addition to the diecasting mold 10 and the machine nozzle 2 shown in part, also comprises a casting vessel not shown, from which the melt 8 passes via the machine nozzle 2 to the diecasting mold 10. Only the first mold plate 11 of the diecasting mold 10 is shown.

The second mold plate, which is not shown, adjoins in the region of the mold cavity side 15 when the diecasting mold 10 is closed. It is moved up to the first mold plate 11 prior to the casting process so that complete mold cavities 14 are formed as cavities, and is moved away to open the diecasting mold 10 for removal of the molded part 16. The second mold plate only has cavities and otherwise no internals or functional elements, which is why the second mold plate has not been shown for the sake of clarity.

Each of the mold cavities 14 is accessible by a demolding system 20, namely by ejector pins 28 on the left side or an ejector sleeve 30 on the right side of the figure, for demolding the molded part 16 from the first mold plate 11. The ejector system 20 is accessible via a mold cavity side 15 of the first mold plate 11 and comprises two drive devices 21, which in the shown embodiment are each equipped with a hydraulic cylinder 22, the piston rods 23 of which are connected to an ejector pressure plate 24. The ejector pressure plate 24 is used to transmit the drive forces from the piston rod 23 to the ejector pins 28 or to the ejector sleeve 30. The ejector pins 28 and the ejector sleeve 30 are held in an ejector holding plate 26. For axial guidance of the ejector sleeve 30, the diecasting nozzle 6 shown on the right is additionally surrounded by an unspecified guide sleeve in addition to a guide plate, while the ejector pins 28 are axially guided in the guide plate. The ejector pins 28 are also guided in the guide plate.

The hydraulic cylinders 22 are located outside the region in which the machine nozzle 2 attaches, the melt channels 4 run and the diecasting nozzle 6 is located. This deviates from the conventional central drive of the demolding system via a central ejector bolt as known from the prior art. It has been shown that the decentralized drive device 21 for generating the demolding force, which is divided among several hydraulic cylinders 22, allows the entire demolding system 20 to be arranged in the first mold plate 11, together with the advantages mentioned in the description.

Since high temperatures of several 100° occur in the first mold plate 11 in particular during diecasting due to the metal melts used in this process, the hydraulic cylinder 22 is configured to be correspondingly temperature-stable and to withstand the temperatures in the first mold plate 11, which depend on the respective melt temperature and thus have different requirements.

Figure 2:
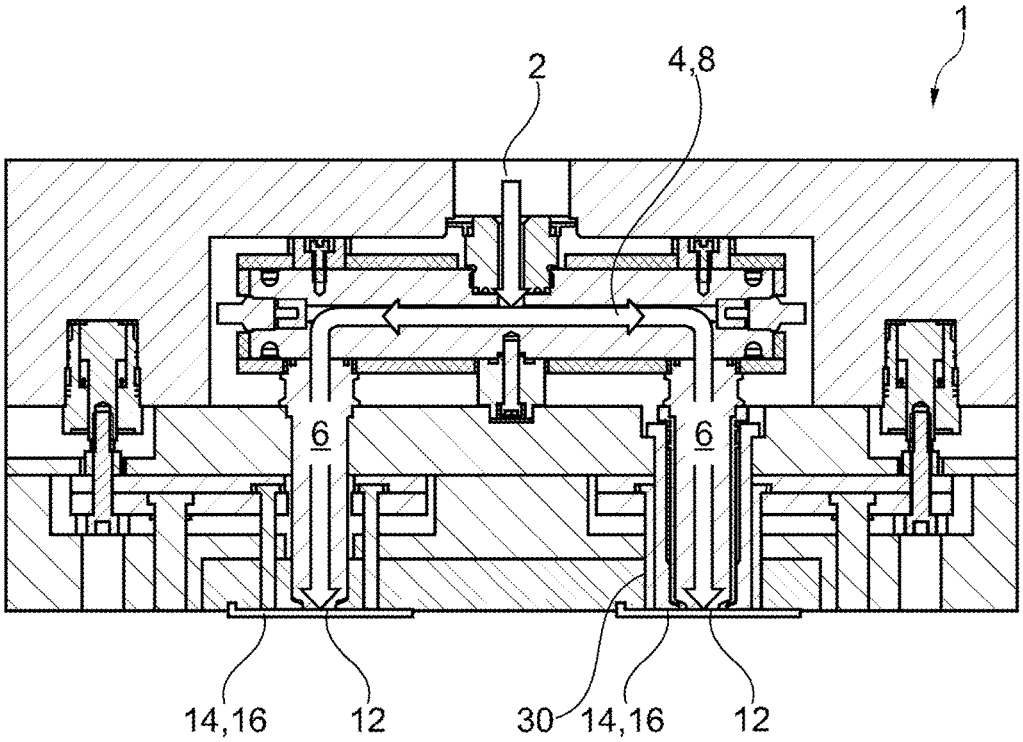
FIG. 2: schematically shows a cross-sectional view of an embodiment of a diecasting mold according to the invention during the formation of a molded part in the casting process.

FIG. 2 schematically shows a cross-sectional view of an embodiment of a diecasting mold 10 according to the invention with a part of the hot chamber system 1 (see description of FIG. 1) during the formation of the molded part 16 in the casting process. The melt flow during the casting process is visualized by thick white arrows. In the process, the melt 8 flows from the machine nozzle 2, which is partially shown with its attachment to the diecasting mold 10, via the melt channels 4 into the diecasting nozzles 6.

From their outlet point 17, the melt 8 enters the mold cavity 14, which is formed between the first mold plate 11 and the second mold plate, not shown, which is in direct contact with the first mold plate 11 when the diecasting mold 10 is closed. This is where the molded part 16 is formed when the melt 8 that has entered the mold cavity 14 cools.

Figure 3:
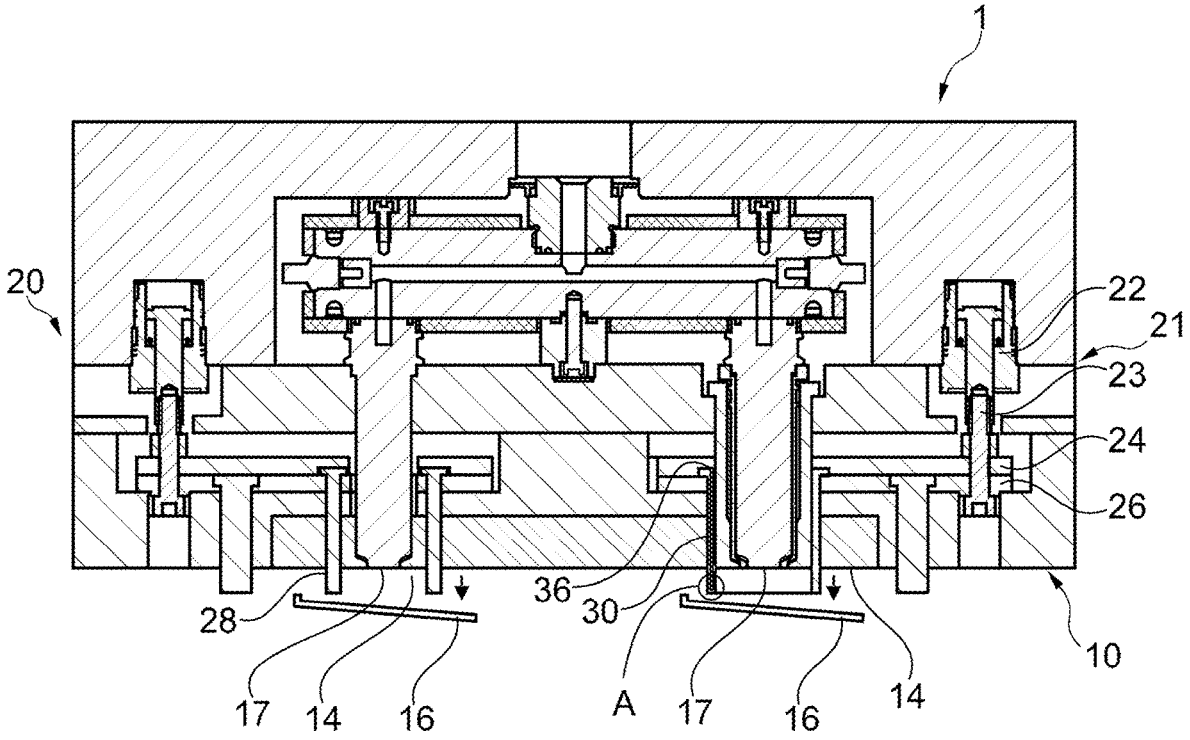
FIG. 3: schematically shows a cross-sectional view of an embodiment of a diecasting mold according to the invention during ejection of a molded part following the casting process.

FIG. 3 schematically shows a cross-sectional view of an embodiment of a diecasting mold 10 according to the invention with a part of the hot chamber system 1 (see description of FIG. 1) during ejection of the molded part 16 formed from the melt 8 that has cooled after its entry into the mold cavity 14.

For ejection, the demolding system 20 is driven by the drive device 21 with the hydraulic cylinder 22, which pushes the piston rods 23 in the direction of the arrow away from the first mold plate 11 (downward in the illustration). This also causes the ejector pressure plate 24, the ejector holding plate 26, the ejector pins 28 and the ejector sleeve 30 to move out of the diecasting mold 10 on the mold cavity side 15 and into the mold cavity 14. The molded part 16 adhering in the mold cavity 14 is thereby released from the mold cavity 14 and the casting process is completed with the ejection of the molded part 16. During ejection, a protective gas connection 36 introduces protective gas, such as nitrogen, into a protective gas line 34 inside the ejector sleeve 30, but also the ejector pins 28, which are not shown as including this equipment. This protective gas exits from the protective gas outlet 32 and enters the region of the mold cavity 14 (see FIG. 4).

Subsequently, the demolding system 20 is moved back to its initial position, in particular the ejector assembly 28, 30 is retracted, so that a new molding process can begin after the diecasting mold 10 is closed, during which the second mold plate, which is not shown, is moved back into contact with the first mold plate 11.

Figure 4:
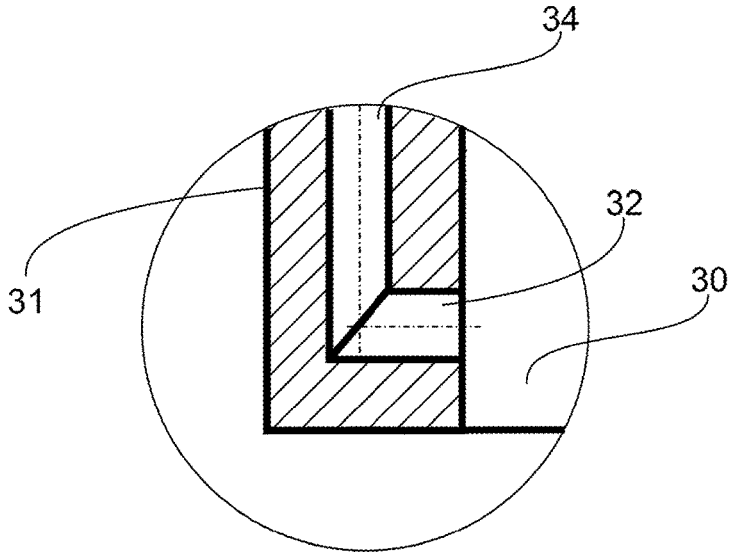
FIG. 4: shows a detail from a cross-sectional view of an embodiment of a diecasting mold according to the invention during ejection of a molded part.

FIG. 4 shows a detail A from a cross-sectional view of an embodiment of a diecasting mold 10 according to the invention during ejection of a molded part 16. The protective gas outlet 32 is shown to be unblocked, so that the protective gas, which flows through the protective gas line inside the ejector wall 31 to the protective gas outlet 32, can escape.

LIST OF REFERENCE NUMERALS

1 hot chamber system (detail)
2 machine nozzle
4 melt channel
6 diecasting nozzle
8 melt
10 diecasting mold; diecasting mold
11 first mold plate

12 gate
14 mold cavity
15 mold cavity side
16 molded part
17 outlet point
20 demolding system
21 drive device
22 hydraulic cylinder
23 piston rod
24 force transmission device; ejector pressure plate
26 ejector holding plate
28 ejector assembly, ejector pin
30 ejector assembly, ejector sleeve
31 ejector wall
32 protective gas outlet
34 protective gas line
36 protective gas connection

The invention claimed is:

1. A diecasting mold (10), comprising a first mold plate (11) which is hot in operation and has at least one diecasting nozzle (6) with an outlet point (17) for a melt, and a second mold plate which forms a cold side, a mold cavity (14) being formed between the first and the second mold plate in a closed state of the diecasting mold (10), in which the mold cavity (14) a molded part (16) can be produced from solidified melt (8) introduced into the mold cavity (14) via at least one melt channel (4) and the at least one diecasting nozzle (6), the diecasting mold (10) further comprising a demolding system (20) for demolding the molded part (16) from the diecasting mold (10), the demolding system (20) comprising an ejector assembly (28, 30), a drive device (21), and a force transmission device (30) connected to the drive device (21) and the ejector assembly (28, 30), characterized in that the demolding system (20) is arranged outside a region of the at least one melt channel (4) and the at least one diecasting nozzle (6) and has a temperature resistance for arrangement in the first mold plate (11), wherein at least one protective gas outlet (32) is provided for delivering a protective gas into the mold cavity (14) toward the outlet point (17) and wherein the at least one protective gas outlet (32) is arranged in the ejector assembly (28,30).

2. The diecasting mold according to claim 1, wherein the at least one protective gas outlet (32) is arranged in an ejector wall (31) in a region that emerges from the first mold plate (11) during ejection, so that the at least one protective gas outlet (32) is unblocked during ejection.

3. A method for diecasting metal provided as a melt, characterized in that, in a diecasting mold (10) according to claim 1, the steps of a. closing the diecasting mold (10) by moving the first mold plate (11) and the second mold plate together and closing the mold cavity (14),
b. introducing the melt (8) from the outlet point (17) of the at least one diecasting nozzle (6) into the mold cavity (14) from the first mold plate (11), which forms a gate side and has the outlet point (17),
c. cooling and solidifying the melt (8) to form the molded part (16),
d. opening the diecasting mold (10) by lifting the second mold plate from the first mold plate (11) and releasing the molded part (16) on one side,
e. activating the demolding system (20),
f. ejecting the molded part (16) by releasing an adhesive connection with the mold cavity (14) in the first mold plate (11) by a force effect of the demolding system (20)

are performed and wherein a protective gas flows into the mold cavity (14) during release of the molded part (16).

4. The method according to claim 3, wherein the protective gas protects the outlet point (17) of the diecasting nozzle (6) from the ingress of oxygen.

5. The method according to claim 3, wherein the protective gas flows out of the ejector assembly (28, 30).

6. The method according to claim 3, wherein nitrogen is used as the protective gas.

* * * * *